US005814938A

United States Patent [19]

B'eland et al.

[11] Patent Number: 5,814,938

[45] Date of Patent: Sep. 29, 1998

[54] COLD CATHODE TUBE POWER SUPPLY

[75] Inventors: Robert Bèland, St. Marthe sur le Lac; Pascal Kaufman, Ville de Deux Montagnes, both of Canada

[73] Assignee: Transfotec International, St. Eustache, Canada

[21] Appl. No.: 692,345

[22] Filed: Aug. 5, 1996

[51] Int. Cl.[6] ..... H01J 23/16

[52] U.S. Cl. ..... 315/3

[58] Field of Search ..... 363/16, 24, 25, 363/97, 133, 134; 323/905; 315/3, 50, 57, 61, 70, 290, 307, 308, DIG. 4, DIG. 7

[56] References Cited

U.S. PATENT DOCUMENTS

| | | | |
|---|---|---|---|
| Re. 32,904 | 4/1989 | Pacholok | 363/131 |
| 1,654,350 | 12/1927 | Shelton . | |
| 1,804,525 | 5/1931 | Cadieux . | |
| 3,550,298 | 12/1970 | O'Neill . | |
| 3,862,411 | 1/1975 | Persson | 240/25 |
| 3,919,798 | 11/1975 | Mutzhas | 40/130 G |
| 3,965,597 | 6/1976 | Noellert | 40/130 DD |
| 4,149,113 | 4/1979 | Sammis | 315/219 |
| 4,277,726 | 7/1981 | Burke | 315/98 |
| 4,286,193 | 8/1981 | King, Jr. et al. | 315/175 |
| 4,370,600 | 1/1983 | Zansky | 315/244 |
| 4,467,248 | 8/1984 | Watanabe et al. | 315/241 P |
| 4,488,090 | 12/1984 | Hancock | 315/201 |
| 4,563,719 | 1/1986 | Nilssen | 361/45 |
| 5,001,400 | 3/1991 | Nilssen | 315/209 R |
| 5,004,955 | 4/1991 | Nilssen | 315/119 |
| 5,051,666 | 9/1991 | Jensen | 315/307 |
| 5,056,125 | 10/1991 | Beland | 378/101 |
| 5,387,845 | 2/1995 | Nilssen | 315/209 R |
| 5,394,065 | 2/1995 | Rimmer | 315/277 |
| 5,424,893 | 6/1995 | Francis, Jr. et al. | 361/45 |
| 5,428,266 | 6/1995 | Nilssen | 315/209 R |
| 5,465,010 | 11/1995 | Rimmer | 307/9.1 |
| 5,489,825 | 2/1996 | Rimmer | 315/277 |
| 5,530,321 | 6/1996 | Sears | 315/283 |

*Primary Examiner*—Matthew V. Nguyen
*Attorney, Agent, or Firm*—Wolf, Greenfield & Sacks P.C.

[57] ABSTRACT

A power supply for a cold cathode tube has a high voltage module coupled directly to the cold cathode tube, and a power control module that provides a power control signal to the high voltage module via low voltage wiring. The power control module has a circuit that compensates for negative resistance of the ionized gas within the cold cathode tube by adjusting a frequency of the power control signal. The power control module also receives a return of from the cold cathode tube, and varies an illumination intensity of the cold cathode tube using a burst modulation technique, and provides shutdown in the event of a ground fault.

6 Claims, 7 Drawing Sheets

COLD CATHODE TUBE POWER SUPPLY

BACKGROUND OF THE INVENTION

1. Field of the Invention

This invention relates generally to gas discharge devices, and more particularly to an improved power supply for cold cathode tubes.

2. Discussion of the Related Art

Cold cathode tubes, also known as neon tubes or gas discharge devices, use an ionization process to provide light. As depicted in FIG. 1, a cold cathode tube 12 is typically a vacuum-sealed glass tube 14 that is filled with a inert gas 16 such as argon or neon. The tube 14 is fitted at each end with a metal electrode 18A, 18B, to provide an electrical contact with the inert gas 16. Pumping outlet 20 allows the inert gas 16 to be input to the tube 14.

The tubes may be fabricated in many shapes. Diameters of 6 mm to 18 mm are typical. As shown in FIG. 2, a tube may also be formed by a cavity 24 formed inside a glass material such as glass plate 22, again with electrodes 18A, 18B, and outlet 20.

In operation, the electrodes 18A, 18B are connected to a high voltage source. When connected to a high voltage source, the ionization process is initiated in which the atoms of the inert gas 16 are stimulated, and the tube will then glow with light from the energy spectrum that depends upon the gas type. For example, a neon tube will glow ruby red, mercury vapor will glow blue-green, and argon will glow pale blue.

Once ionized, a constant current is maintained through the gas at a voltage referred to as a running voltage. This constant current is typically in the range of 10 to 120 mA. In order to ionize the gas initially, a striking voltage of approximately 1.5 times the running voltage is provided to the electrodes.

The striking and running voltages are typically directly proportional to the tube length, and are typically in the range of 500–8000 Vrms for tubes having a length of approximately one foot to a length of several feet. The luminous intensity of the inert gas 16 is directly proportional to the current which flows through the inert gas 16.

An example of a known power supply for cold cathode tubes is depicted in FIG. 3. The high voltage converter 30 receives an input voltage Vin, and generates an output voltage Vout. Vin may be an AC supply such as 110 VAC or 220 VAC for household or commercial applications, or a DC supply such as 12 V for automotive applications. The output voltage Vout is provided to cold cathode tube 12 by high voltage cables 32. Typically, Vout has a square shape waveform, and represents an open circuit voltage in the range of 1,000 V to 15,000 V. Due to the potential safety hazards, it is desirable that the high voltage cables 32 be as short as possible. This consideration limits the size and weight of the high voltage converter 30, since in order to keep the high voltage cables 32 short, the high voltage converter 30 is typically mounted as close as possible to the tube 12. Also for safety reasons, the high voltage cables 32 are often installed in a conduit. The installation of the high voltage cables requires special consideration, and must often adhere to strict safety codes. Furthermore, if the high voltage wires must pass through a wall, then a special insulator is required to pass the wires through the wall in order to comply with safety requirements.

A conventional method for varying the luminous intensity of a tube 12 is to directly limit current flow in the tube.

However, due to the high frequency of the voltage at the tube, the capacitive loss within the tube will cause current to decrease in a non-uniform manner along the length of the tube. Accordingly, a dark area typically appears in the center or at one end of the tube 12. Additionally, if current has been directly limited, and fluctuations in the input power are present, additional dark areas may appear.

Another characteristic of cold cathode tubes is that the inert gas 16 within a tube 12 creates an apparent negative resistance. As the inert gas 16 ionizes, the resistance as sensed by the high voltage converter 30 decreases, causing the current within the tube to rapidly increase when power is initially applied to the tube 12. This rapid increase of current will cause instability in a tuned circuit within high voltage converter 30 that is providing power to the tube 12, and may in some instances damage the tuned circuit if implemented as a solid state power oscillator. Therefore, it has been necessary to provide a current limiting inductor in series with the tube 12, between the tube 12 and high voltage converter 30, in order to regulate the load current. However, such an arrangement causes RFI (Radio Frequency Interference) and EMI (Electromagnetic Interference) difficulties, because of the resulting unbalance between the load current limiting inductor and the tuned circuit providing the high voltage. Due to the harmonics that would be generated otherwise, the tuned circuit must be physically located close to the load current limiting inductor, which limits the options in which to physically arrange the high voltage converter 30.

It would be desirable to provide a power supply for a cold cathode tube which uses a minimum of high voltage wiring, or no high voltage wiring at all. It would also be desirable to vary the illumination of a cold cathode tube without dark areas, and in the presence of input voltage variation. It would also be desirable to provide compensation for the negative resistance of the inert gas.

SUMMARY OF THE INVENTION

An embodiment of the invention is directed to a power supply for providing high voltage power to a cold cathode tube in which low voltage wiring may be used to couple a control module to a high voltage module that is located at the cold cathode tube. A low voltage power control signal is generated by the control module and provided across the low voltage wiring to the high voltage wiring, so that high voltage wiring is minimized and in many cases eliminated.

One embodiment comprises a control module having an input that receives an input voltage and an output that provides a power control signal, a high voltage module, coupled to the control module, having an input that receives the power control signal from the control module and an output that provides the high voltage power to the cold cathode tube. Additionally, the high voltage module may be mounted internal to the cold cathode tube.

In one embodiment, the control module includes a ground fault protection circuit, having an input that receives a signal indicative of a power return of the cold cathode tube, and an output that inhibits the high voltage module from generating the high voltage power when the signal indicative of the power return of the cold cathode tube is indicative of a ground fault condition.

In another embodiment, the control module includes a variable intensity circuit, which may include a burst modulation generator that generates the power control signal at a high frequency only during certain periods, referred to as burst periods. Additionally, the control module may further include a control input that receives an intensity control signal, the intensity control signal being provided to the burst modulation generator to determine the burst period.

The control module may also include a negative resistance compensation circuit, having an input that receives a signal indicative of a negative resistance of the cold cathode tube, and an output that controls a frequency of the power control signal to compensate for the negative resistance.

Another embodiment of the invention is directed to a method for powering a cold cathode tube, comprising the steps of receiving an input voltage, transforming the input voltage to a power control signal, and providing the power control signal to a high voltage transformer located at or in the cold cathode tube, so that the high voltage transformer transforms the power control signal to a high voltage signal that powers the cold cathode tube. The step of providing may include providing the power control signal across low voltage wiring.

The method may further include the steps of detecting when a return signal is being returned to a control module from the cold cathode tube, the return signal being in response to the high voltage signal, and when the return signal is not being returned from the cold cathode tube, inhibiting the step of providing the power control signal. The step of providing may also include the steps of providing the power control signal as a burst modulated signal having a duty cycle, increasing the duty cycle to increase an illumination intensity of the cold cathode tube, and decreasing the duty cycle to decrease the illumination intensity of the cold cathode tube.

The step of providing the power control signal may include the steps of receiving a return signal being returned from the cold cathode tube, the return signal being in response to the high voltage signal, integrating the return signal over time to generate a ramp voltage that decreases while the return signal is being returned, turning off the power control signal when the ramp voltage reaches a first threshold voltage, and turning on the power control signal when the ramp voltage reaches a second threshold voltage that is lower than the first voltage, to provide the power control signal as a burst modulated signal and control an illumination intensity of the cold cathode tube.

In another embodiment, the step of providing the power control signal includes providing the power control signal at a first frequency, and the step of providing the power control signal further includes the steps of detecting a negative resistance of the cold cathode tube, and increasing the first frequency of the power control signal, to decrease a current that flows through the cold cathode tube and compensate for the negative resistance.

Another embodiment of the invention is directed to an apparatus for powering a cold cathode tube, comprising means for receiving an input voltage, means for transforming the input voltage to a power control signal, and means for providing the power control signal to a high voltage transformer located at or in the cold cathode tube, so that the high voltage transformer transforms the power control signal to a high voltage signal that powers the cold cathode tube.

BRIEF DESCRIPTION OF THE DRAWINGS

Other features and advantages of the present invention shall appear from the following description of an exemplary embodiment, said description being made with reference to the appended drawings, of which.

DETAILED DESCRIPTION

An illustrative embodiment of the invention is directed to a constant current power supply for a cold cathode tube, with minimized high voltage wiring, ground fault protection, negative resistance compensation, and variable intensity.

Figure 1:
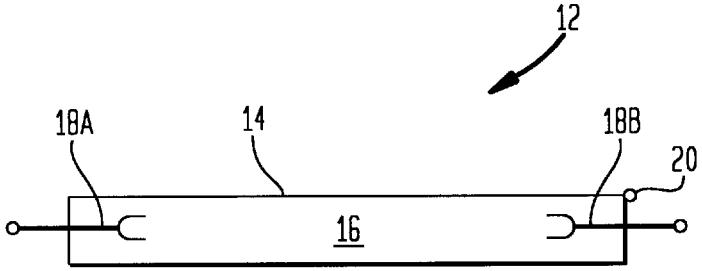
FIG. 1 is a diagram of a cold cathode tube.
Figure 2:
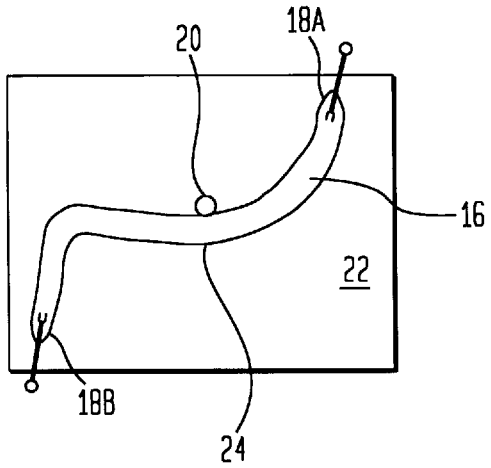
FIG. 2 is a diagram of an alternate assembly to FIG. 1, in which the cold cathode tube is formed in a cavity of a plate of glass.
Figure 3:
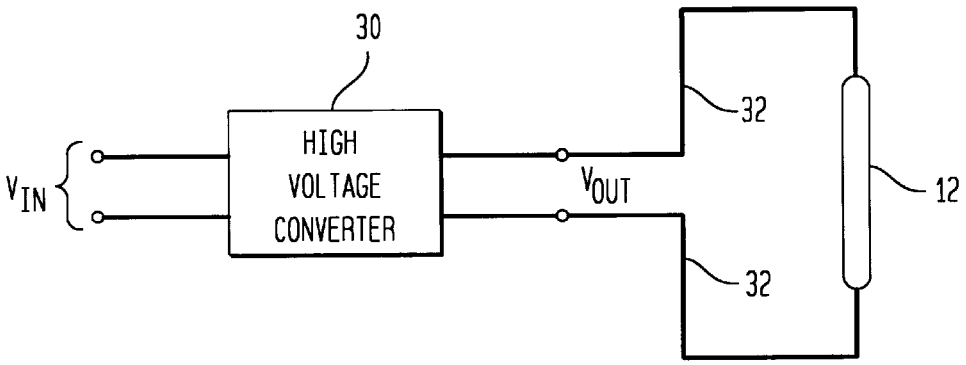
FIG. 3 is a diagram of a known high voltage converter for supplying electrical power to a tube such as those shown in FIGS. 1 and 2.
Figure 4:
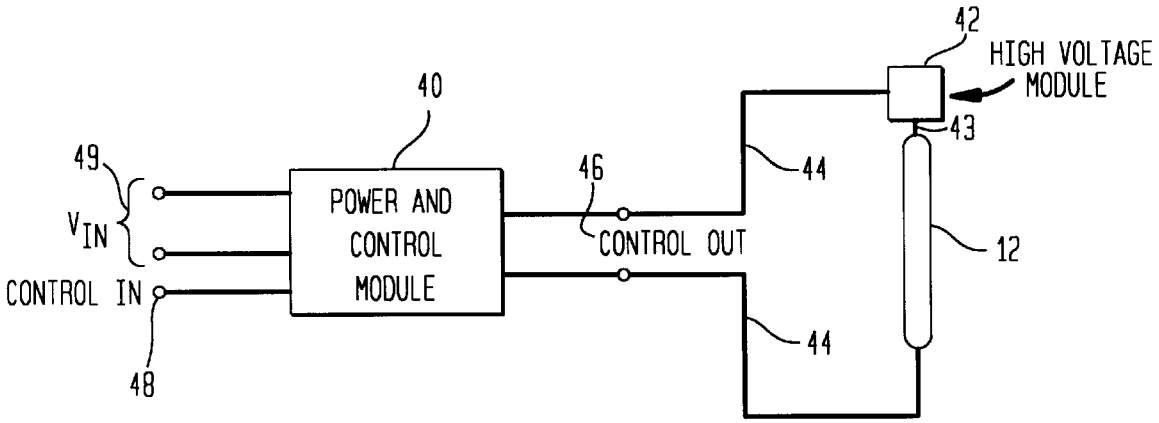
FIG. 4 shows a block diagram of a cold cathode tube power supply in accordance with an embodiment of the invention which reduces or eliminates high voltage wiring.

FIG. 4 illustrates a block diagram of an embodiment of the invention. A power and control module 40 receives Vin 49 and a control signal "control in" 48. The control signal may be received on a single wire, multiple wires, or any known arrangement for communicating data. The output of the power and control module 40 is a low voltage power control signal, "control out" 46, which may be routed on normal wiring 44, instead of requiring high voltage wiring 32 as shown in FIG. 3. High voltage module 42 receives the low voltage power control signal from the power and control module, and in turn generates a high voltage signal 43 which powers the tube 12.

The arrangement depicted in FIG. 4 minimizes any high voltage wiring, because the only high voltage is in the connection between high voltage module 42 and the tube 12, and the length of this connection is minimized. In an alternative embodiment, the high voltage module is located internal to the tube, so that all high voltage wiring is effectively eliminated.

Figure 5:
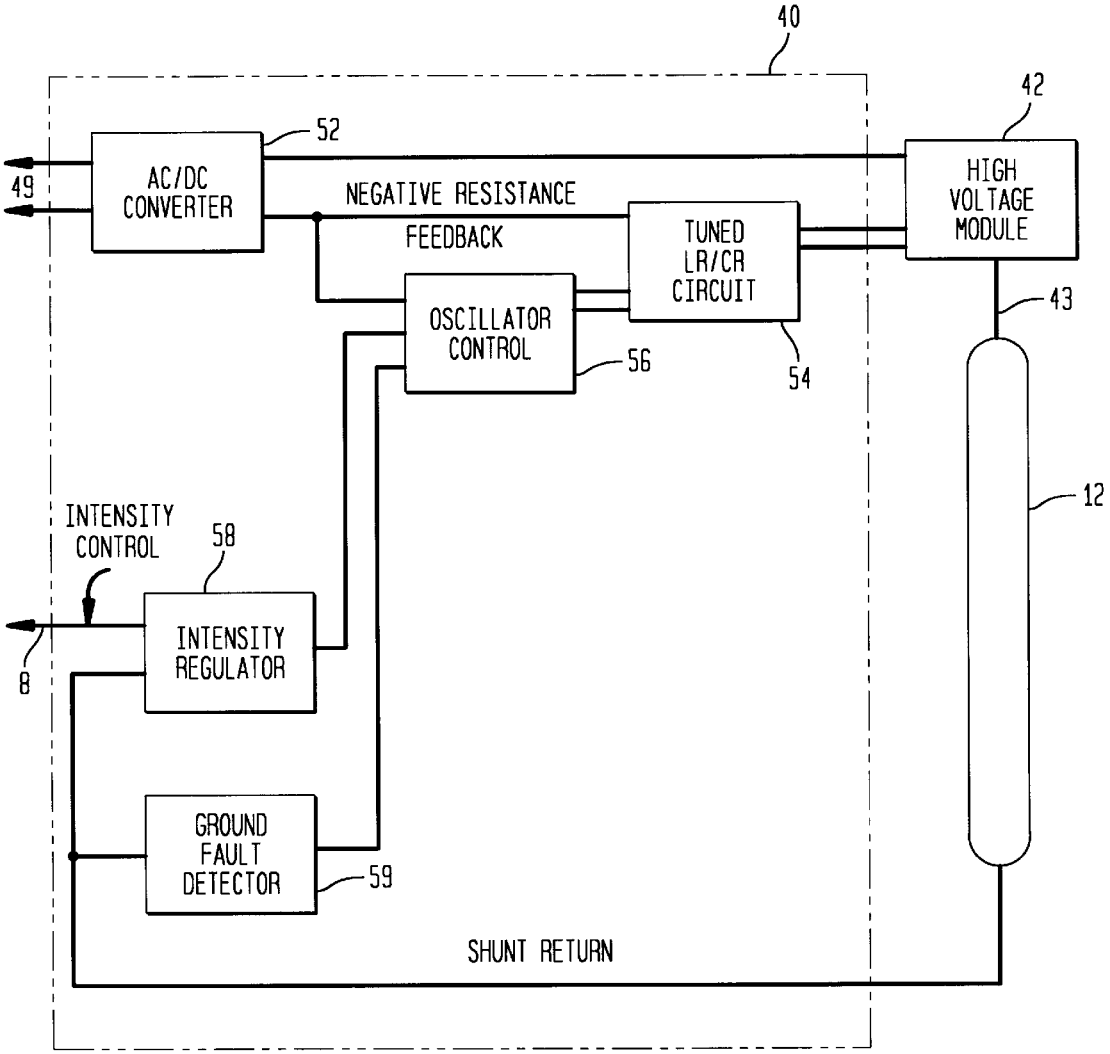
FIG. 5 is a block diagram of the power and control module of FIG. 4, depicting several features including ground fault protection, variable intensity control, negative resistance compensation, and low voltage cabling.

FIG. 5 is a block diagram showing elements of one embodiment of the power and control module 40, connected to high voltage module 42 and tube 12. Power and control module 40 includes AC/DC converter 52, tuned LR/CR circuit 54, oscillator control 56, intensity regulator 58, and ground fault detector 59. AC/DC converter 52 is connected to a power source, and powers the circuits of the power and control module 40. Additionally, AC/DC converter 52 is connected to high voltage module 42, as well as tuned LR/CR circuit 54, and oscillator control 56. Intensity regulator 58 receives input from external intensity control, as well as a shunt return from tube 12. Ground fault detector also receives a shunt return from tube 12, and both intensity regulator 58 and ground fault detector 59 provide input to oscillator control 56.

In operation, AC/DC converter 52 receives external AC power, and provides the circuits of power and control module 40 with DC power. Alternatively, if DC power is available externally, such as in automotive applications, AC/DC converter 52 is not required. Tuned LR/CR circuit generates the low voltage AC power signal that powers the high voltage module 42, and also provides negative resistance feedback to oscillator control 56. This negative resistance feedback, as described below in more detail, is representative of the negative resistance of the gas 16 within the tube 12. Oscillator control 56 controls the tuned LR/CR circuit to operate at an appropriate frequency to compensate for the negative resistance. Oscillator 56 also provides pulse on/off control to the tuned LR/CR circuit in response to input from intensity regulator 58, or shuts down in response to input from ground fault detector 59. Intensity regulator 58 receives an intensity control input, as well as a shunt return from the tube 12. Depending upon the relationship between the shunt return and the intensity control input, the intensity regulator provides pulse on/off control, also called burst modulation, to achieve the desired tube intensity. Ground fault detector 59 also receives the shunt return, and deactivates oscillator control 56 if there is a ground fault.

Figure 6:
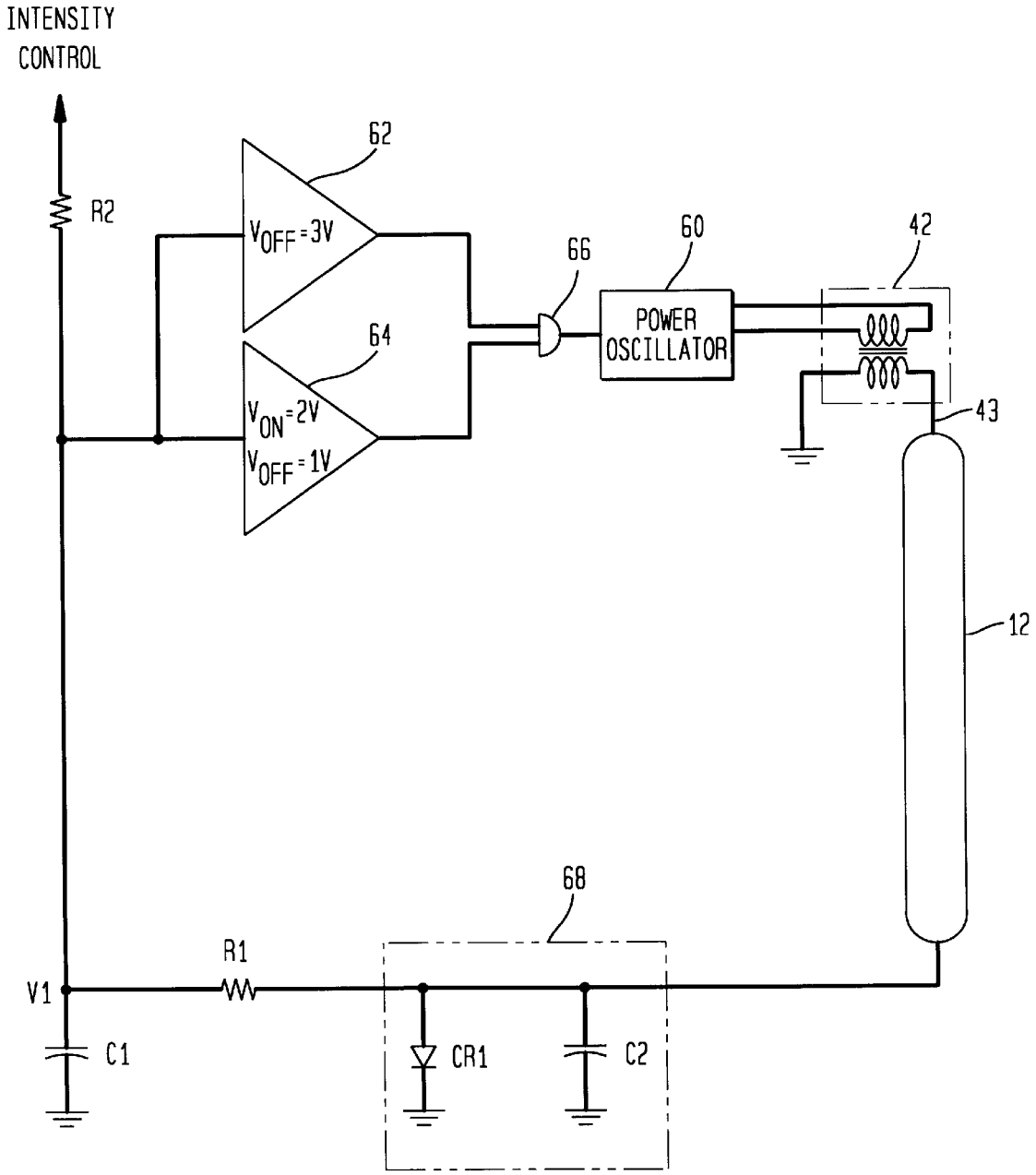
FIG. 6 is a circuit diagram showing an embodiment of the ground fault protection and variable intensity features of the block diagram of FIG. 5.
Figure 7:
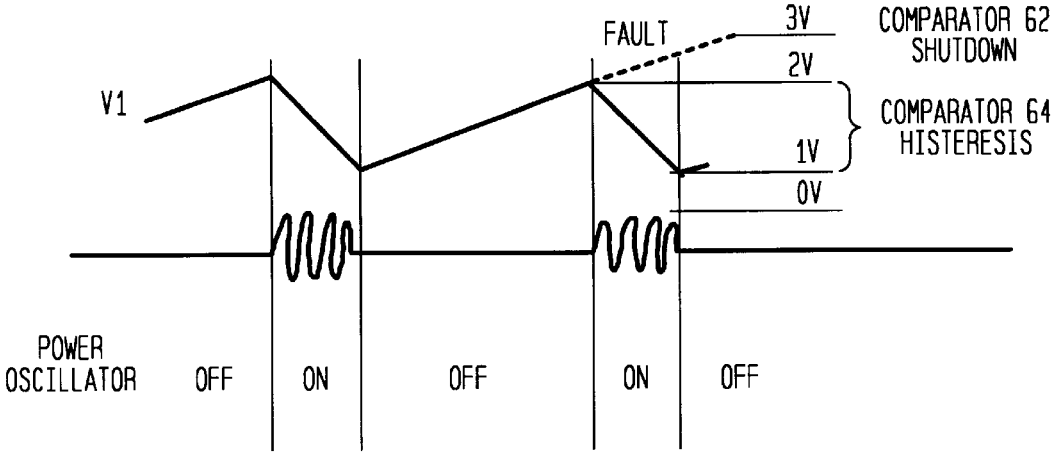
FIG. 7 is a timing diagram showing the burst modulation technique achieved by the circuit of FIG. 6.

FIG. 6 is a circuit diagram showing an embodiment of the ground fault protection and variable intensity features of the block diagram of FIG. 5, and may be interpreted with respect to the timing diagram of FIG. 7. FIG. 5 shows an intensity control input, which provides a voltage across resistor R2, and capacitor C1 and resistor R1 in parallel, Resistor R1 is connected to ground through current shunt return 68 made up of diode CR1 and capacitor C2, which are connected to the return of tube 12. Voltage V1 is provided to comparator 62 and hysteresis comparator 64, which in turn provide inputs to AND gate 66. AND gate 66 controls the power oscillator 60, which provides the low AC voltage signal to the high voltage module 42. Power oscillator 60 is represented by oscillator control 56 and tuned LR/CR circuit 54 of FIG. 5. Several alternatives and equivalents to these components are understood to be a part of this disclosure. For example, the function performed by comparators 62, 64 may be performed with digital control, and the control signals may be inverted. Additionally, the intensity control is shown as an analog input. However, a digital input would suffice to provide two levels of intensity, or an infinite number of levels may be provided. Moreover, elements of the circuit may be replaced by a fixed or adjustable astable generator to provide a duty cycle input to power oscillator 60.

The operation of the circuit of FIG. 6 is as follows. When power is initially applied, C1 is discharged and the voltage V1 is below 1 V. Comparator 62 is ON because the input to comparator 62 is below 3 V, and hysteresis comparator 64 is OFF because the input is below 2 V. Therefore, the power oscillator 60 is not operating, and the tube condition is OFF. Intensity control input causes current to flow through R2, causing C1 to charge and the voltage V1 to increase. As the voltage V1 increases to 2 V, comparator 64 activates, which causes AND gate 66 to activate, which in turn activates power oscillator 60 and turns tube 12 ON.

The circuit of FIG. 6 may be referred to as a variable intensity circuit, and power oscillator 60 operates as a burst modulation generator that generates the power control signal that is provided to high voltage module 42 at a high frequency during burst periods. With power oscillator 60 activated, the high voltage module 42 causes the tube 12 to be activated. The striking voltage is achieved, and due to negative resistance within the inert gas 16, the high voltage module 42 output settles to a running voltage. At this point, the voltage across C1 will begin to decrease due to the negative voltage developed across shunt return 68, which is caused by the AC return from tube 12 provided to diode CR1 and capacitor C2. This negative voltage will cause current to flow across R1 from V1 to the negative voltage at CR1, which reverses the current into C1, and decreases the voltage V1. Once the voltage V1 reaches the lower level of hysteresis comparator 64, for example 1 V, then hysteresis comparator 64 will turn OFF, deactivating the power oscillator 60, and turning off the tube 12. At this point, the negative voltage will diminish, again causing the voltage V1 to increase until the power oscillator 60 is again activated, as shown in FIG. 7. The voltage V1 may be considered a ramp voltage, and the circuit of resistors R1 and R2, capacitors C1 and C2, and diode CR1 may be considered an integrator that integrates the return of the tube 12 over time.

If the tube 12 is broken, or either end is grounded by a fault condition, for example, then no more negative voltage will be developed across CR1 and C2. As a result, C1 will charge through R2 until the voltage crosses the threshold of comparator 62. At this point, comparator 62 will shut down the power oscillator and no more high voltage will be present at the tube 12.

As described above, an embodiment of the invention provides a burst modulation technique in order to provide variation of luminous intensity of a tube 12. In one embodiment, the high frequency carrier of power oscillator 60 is modulated with a burst at a recurrent frequency rate established between 60 and 500 Hz. The variation of the burst duty cycle, as shown in FIG. 7, defines the quantity of energy dissipated in the tube 12 and produces proportional luminous levels. Due to the human eye natural persistence, in which the human eye integrates detected light over time, only the average light energy is perceived, and a human will therefore see a constant and uniform luminous output along the tube, even when the duty cycle is reduced.

The ratio of current between R1 and R2 sets the ON/OFF time ratio of the power oscillator 60. The frequency of the ON/OFF switching is generally sufficiently high so that the human eye does not detect any flicker. The intensity control input therefore causes a higher intensity of the tube 12 as the intensity control input voltage is increased. In one embodiment, two different levels are provided for two different intensities. Such an embodiment is particularly applicable in automotive applications, where a daytime intensity and a nighttime intensity are both desired.

The circuit of FIG. 6 also provides intensity control in the presence of supply voltage fluctuations. For example, if the supply voltage is low, the current shunt return 68 will create less negative voltage due to the lower tube current. This, in turn, causes less negative current to flow through R1, which causes more time to elapse for C1 to charge. Accordingly, it takes longer for the Von of hysteresis comparator 64 to be reached, thereby increasing the duty cycle and causing the tube 12 to be on for a longer amount of time. Therefore, the lower supply voltage is compensated for. A similar inverse situation exists if a higher supply voltage is provided, in which the duty cycle will be decreased due to more negative voltage developed across C2 and CR1, and tube intensity decreased. As a result, the ON/OFF ratio is inversely proportional to peak brightness, keeping the apparent intensity constant despite variations in the input voltage.

Figure 8:
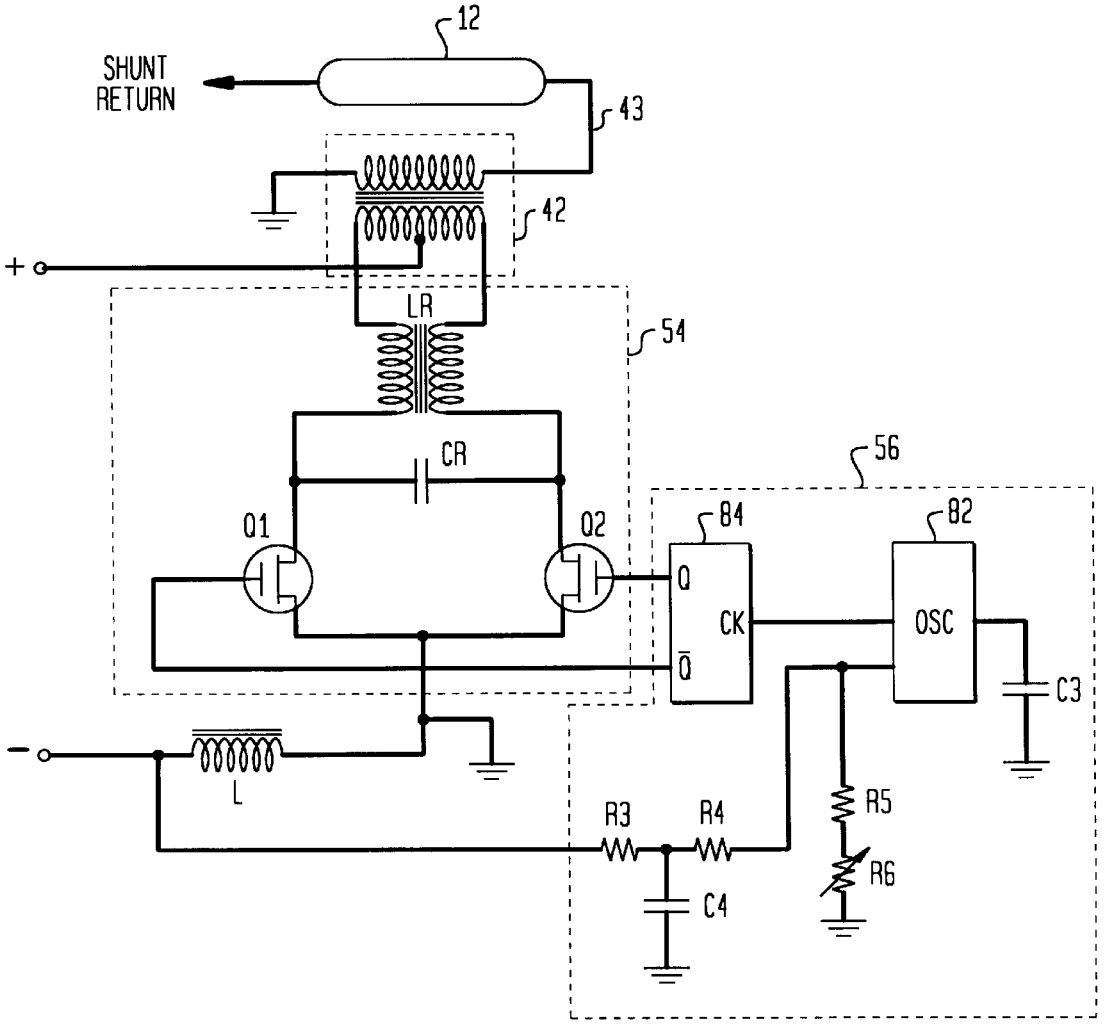
FIG. 8 is a circuit diagram showing an embodiment of the negative resistance compensation feature, which also facilitates the reduction or elimination of high voltage wiring.

FIG. 8 is a circuit diagram showing a detailed embodiment of tuned LR/CR circuit 54 together with oscillator control 56 which make up a negative resistance compensation circuit. The tube 12 is powered from high voltage module 42 as in previous embodiments, although the shunt return 68 and other circuits of FIG. 6 are not necessary to this embodiment. Tuned LR/CR circuit 54 includes a separate inductor LR having two windings with equal number of turns, connected to the high voltage converter 42 as well as to a matched capacitor CR. Transistors Q1 and Q2 control the two push-pull legs of the inductor LR. The push-pull return through each of the two legs is connected to the negative DC return via inductor L. The negative DC return is also connected to oscillator 82 via resistors R3, R4, and capacitor C4. C3 is a timing capacitor for control of the oscillator 82, and R5 and R6 represent timing resistors. In one embodiment, R6 is provided as a variable resistor to allow further adjustment. Flip flop 84 couples the oscillator 84 to the transistors Q1, Q2 of the tuned LR circuit 54. The oscillator 82, flip-flop 84, and associated resistors and capacitors make up oscillator control circuit 54.

The circuit of FIG. 8 provides feedback control to adjust the frequency of the power signal provided to the tube, in order to compensate for the negative resistance effects of the ionized gas 16 within the tube. In general, a higher frequency decreases current in the arc within the inert gas 16. In the circuit of FIG. 8, the current flowing into the primary side of high voltage module 42 is determined by the inductive reactance at the operating frequency and the voltage across matched capacitor CR. The negative resistance feedback occurs through the inductor L, which is then sensed by oscillator control circuit 56. The input to oscillator 82 is adjusted so that if there is more negative resistance represented by the feedback through inductor L, then the frequency of the oscillator 82 will be increased. This frequency is provided to the flip-flop 82, which controls the push-pull legs of the tuned LR/CR circuit 54, which divides the frequency by two, and assures symmetry on each of the transistors Q1, Q2.

Accordingly, as the arc resistance in the tube 12 decreases, the feedback drives the oscillator 82 frequency higher, which in turn decreases the current in the arc. This causes the output of the high voltage module 42 to stabilize in amplitude. Without this feedback, or alternatively a current limiting inductor, the current within the tube would increase rapidly, causing instability and potential damage to the driving components.

Because of the two windings of LR each being connected to capacitor CR, the voltage on each side of the high voltage module is always a sine wave of voltage and current which is equal and out of phase. Because the current through tuned LR/CR circuit 54 is controlled, the tube current will be this current provided from tuned LR/CR circuit 54, divided by the turns ratio of the high voltage module 42. Therefore, no inductor is required to be in series with the tube, which has previously been a disadvantage with respect to physical location and RFI and EMI considerations. Therefore, the transformer within the high voltage module and the high voltage module 42 itself may be located physically far away from the tuned LR/CR circuit. Such an arrangement facilitates the remote power control architecture of FIG. 4.

Additionally, because the AC voltage and current on each side of the transformer within the high voltage module 42 is equal and out of phase, the resultant emitted RFI and EMI are minimal. Also, since the transformer within the high voltage module 42 is not part of the inductance of the tuned LR/CR circuit 54, it represents a closed magnetic circuit which provides a low EMI emission.

Moreover, multiple high voltage modules 42 and tubes 12 may now be connected in series with a single LR/CR circuit, and the same current will flow though all connected modules 42 and tubes 12, giving equal current to all of the tubes 12.

Figure 9:
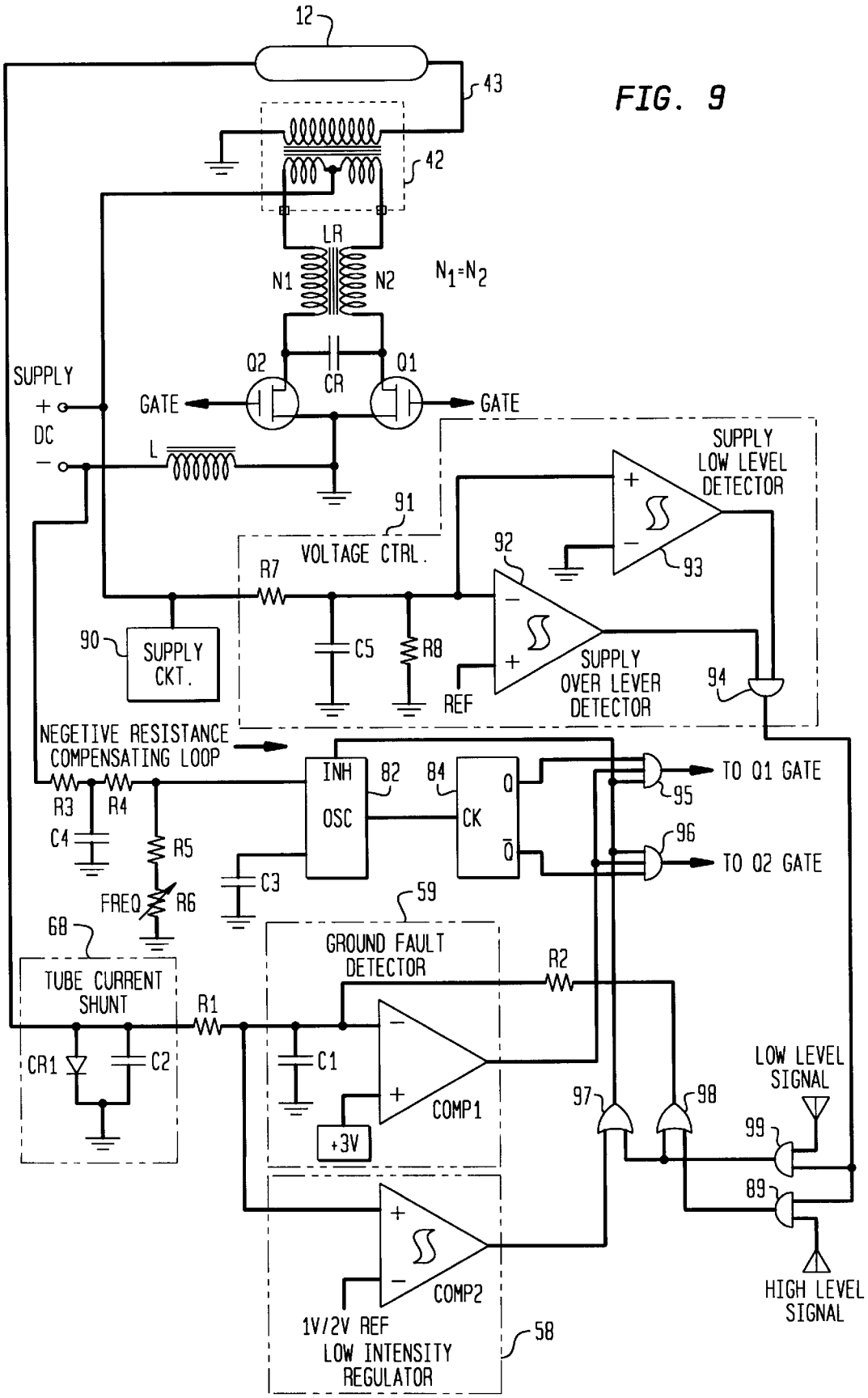
FIG. 9 is a circuit diagram showing a detailed embodiment of the block diagram of FIG. 4.

FIG. 9 is a circuit diagram showing a detailed embodiment of the block diagram of FIG. 5, and shows the detailed circuitry of FIG. 6 in conjunction with the detailed circuitry of FIG. 8, for example the tuned LR/CR circuit, transistors Q1 and Q2, inductor L, the negative resistance compensation circuit, the tube current shunt 68, ground fault detector 59, and low intensity regulator 58. Additionally, supply circuit 90 provides regulation of a DC supply input, and voltage control circuit 91 detects both a low supply condition and a high supply condition, as performed by the circuit of resistors R7 and R8, capacitor C5, and comparators 92 and 93. The outputs of comparators 92 and 93 are input to AND gate 94, the output of which represents a shutdown condition in the event of either low supply condition or high supply condition.

The logic shown varies from the earlier logic shown in FIGS. 6 and 8, in order to combine the functions with the low and high power shutdown feature, but the overall functionality is the same. In particular, the output of AND gate 94 is provided to AND gates 89 and 99. AND gate 89 also receives a high level intensity signal, and AND gate 99 also receives a low level intensity signal. The outputs of AND gates 89 and 99 are provided to OR gate 98, the output of which represents a high intensity condition, and is therefore provided to resistor R2. The output of AND gate 99 is also provided to OR gate 97 along with the output of low intensity regulator 58, in order to provide a signal representative of the intensity burst modulation. AND gates 95 and 96 control the transistors Q1 and Q2. Each of the two AND gates 95 and 96 receive the burst modulation control signal from OR gate 97, the fault shutdown signal from ground fault detector 59, and one of the complementary signals from flip-flop 84.

Figure 10:
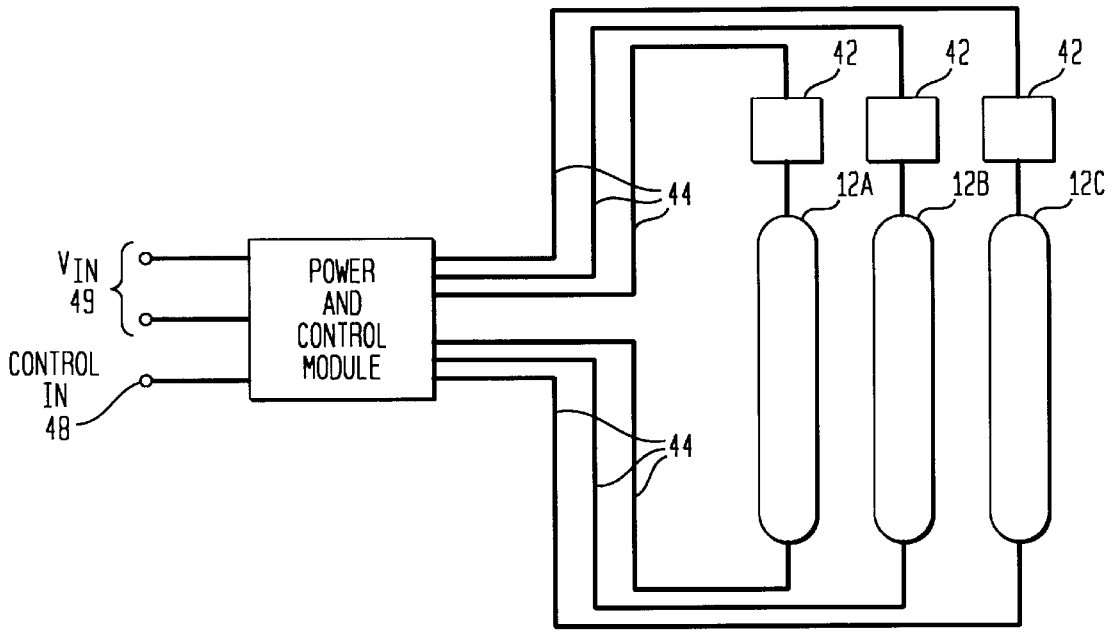
FIG. 10 illustrates an embodiment of the invention in which several tubes are connected in parallel.
Figure 11:
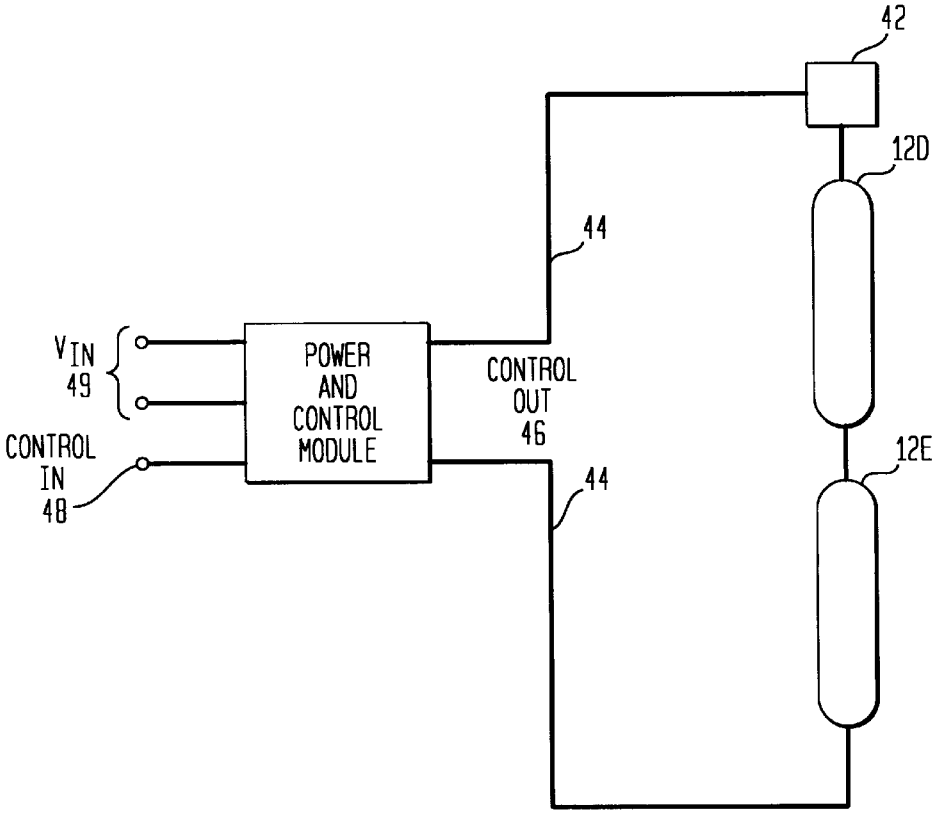
FIG. 11 illustrates an embodiment of the invention in which several tubes are connected in series.

FIGS. 10 and 11 show examples of multiple tubes being controlled in series and parallel. In particular, FIG. 10 depicts tubes 12A, 12B, and 12C connected in parallel, and FIG. 11 depicts tubes 12D and 12E connected in series with a single high voltage module 42. In each of these cases, low voltage wiring may be used to interconnect the high voltage modules 42 with the power and control module 40, so that safety hazards are reduced.

Having thus described several embodiments of the invention, various alterations, modifications, and improvements will readily occur to those skilled in the art. For example, several equivalents to the circuits described may be designed, such as digital control, or the variation of the voltages described. Such alterations, modifications, and improvements are intended to be within the spirit and scope of the invention. Accordingly, the foregoing description is by way of example only, and not intended to be limiting. The invention is limited only as defined in the following claims and the equivalents thereto.

What is claimed is:

1. A power supply for providing high voltage power to a cold cathode tube comprising:

a control module including an input that receives an input voltage and an output that provides a high frequency low voltage power signal; and a high voltage module coupled to the control module, including an input that receives the high frequency low voltage power signal from the control module and an output that provides the high voltage power to the cold cathode tube wherein the high voltage module is mounted internal to the cold cathode tube.

2. A power supply for providing high voltage power to a cold cathode tube comprising:

a control module including an input that receives an input voltage and an output that provides a power control signal; and a high voltage module, coupled to the control module, including an input that receives the power control signal from the control module and an output that provides the high voltage power to the cold cathode tube;

wherein the control module includes a negative resistance compensation circuit, having an input that receives a signal indicative of a negative resistance of the cold cathode tube, and an output that controls a frequency of the power control signal to compensate for the negative resistance.

3. A method for powering a cold cathode tube, comprising the steps of:

receiving an input voltage;

transforming the input voltage to a high frequency low voltage power signal; and providing the high frequency low voltage power signal to a high voltage transformer mounted internal to the cold cathode tube so that the high voltage transformer transforms the high frequency low voltage power signal to a high voltage signal that powers the cold cathode tube.

4. A method for powering a cold cathode tube, comprising the steps of:

receiving by a control module an input voltage;

transforming in the control module the input voltage to a high frequency low voltage power signal; and providing the high frequency low voltage power signal across low voltage wiring to a high voltage transformer located at the cold cathode tube so that the high voltage transformer transforms the high frequency low voltage power signal to a high voltage signal that powers the cold cathode tube, wherein the control module includes a negative resistance compensation circuit, including an input that receives a signal indicative of a negative resistance of the cold cathode tube, and an output that controls a frequency of the power control signal to compensate for the negative resistance.

5. An apparatus for powering a cold cathode tube, comprising:

control module means for receiving an input voltage and for transforming the input voltage to a high frequency low voltage power signal; and means for providing the high frequency low voltage power signal to a high voltage transformer means located at the cold cathode tube for transforming the high frequency low voltage power signal to a high voltage signal that powers the cold cathode tube;

wherein the control module means includes a negative resistance compensation circuit means, including an input means for receiving a signal indicative of a negative resistance of the cold cathode tube, and an output means for controlling a frequency of the power control signal to compensate for the negative resistance.

6. A power supply for providing high voltage power to a cold cathode tube comprising:

a control module including an input that receives an input voltage and an output that provides a high frequency low voltage power signal, the control module including a tuned power circuit that provides the high frequency low voltage signal, wherein the tuned power circuit includes an inductor circuit having a first push/pull leg and a second push/pull leg;

a first push/pull circuit coupled to the first push pull leg; and a second push/pull control circuit coupled to the second push/pull leg;

wherein the first and second push/pull circuits control the inductor circuit so that a voltage at the first push/pull leg remains substantially equal to but out of phase with a voltage at the second push/pull leg; and a high voltage module, coupled to the control module, including an input that receives the high frequency low voltage power signal from the control module and an output that provides the high voltage power to the cold cathode tube.

* * * * *